US012698177B2

(12) United States Patent
Kim et al.

(10) Patent No.: US 12,698,177 B2
(45) Date of Patent: Aug. 4, 2026

(54) TAPE FEEDING APPARATUS

(71) Applicant: Samsung Display Co., Ltd., Yongin-si (KR)

(72) Inventors: Dongwoo Kim, Yongin-si (KR); Sanghoon Park, Yongin-si (KR); Hee Soo Han, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 422 days.

(21) Appl. No.: 18/515,607

(22) Filed: Nov. 21, 2023

(65) Prior Publication Data

US 2024/0208768 A1 Jun. 27, 2024

(30) Foreign Application Priority Data

Dec. 21, 2022 (KR) ..... 10-2022-0180219

(51) Int. Cl.
*B65H 29/54* (2006.01)
*B65H 35/00* (2006.01)
(Continued)

(52) U.S. Cl.
CPC ..... *B65H 29/54* (2013.01); *B65H 35/0086* (2013.01); *B65H 37/002* (2013.01);
(Continued)

(58) Field of Classification Search
CPC ..... B65H 29/54; B65H 29/56; B65H 35/00; B65H 35/0073; B65H 35/008; B65H 35/0086; B65H 37/00; B65H 37/002; B65H 37/005; B65H 41/00; B65H 43/08; B65H 2301/4481; B65H 2301/4482; B65H 2301/44822; B65H 2301/5112; B65H 2301/51122; B65H 2553/42; B65H 2553/46; B65H 2701/194; B65H 2701/37; B65H 2701/377; B65H 2701/3772; B65H 2701/378; B65H 2701/379;
(Continued)

(56) References Cited

U.S. PATENT DOCUMENTS 4,173,510 A * 11/1979 Tobey ..... B65C 9/0006 156/764
4,182,645 A * 1/1980 Hill ..... B65H 35/0066 156/361
(Continued)

FOREIGN PATENT DOCUMENTS

DE 19648181 A1 * 5/1998 ..... B65H 29/60
JP 2004361329 A 12/2004
(Continued)

*Primary Examiner* — Emmanuel M Marcelo
*Assistant Examiner* — Raveen J Dias
(74) *Attorney, Agent, or Firm* — CANTOR COLBURN LLP

(57) ABSTRACT

A tape feeding apparatus includes a supply unit that supplies a release paper and a tape attached to the release paper, a blade unit that separates the release paper and the tape, having a triangular pillar shape extending in a first direction, and including a first surface, a second surface directed perpendicular to the first surface and contacting the release paper, and a third surface in contact with the first surface and the second surface to form a sloped surface, and an lighting unit attached to the first surface.

20 Claims, 8 Drawing Sheets

(51) Int. Cl.
*B65H 37/00* (2006.01)
*B65H 41/00* (2006.01)
*B65H 43/08* (2006.01)

(52) U.S. Cl.
CPC ..... *B65H 43/08* (2013.01); *B65H 41/00* (2013.01); *B65H 2301/4481* (2013.01); *B65H 2301/51122* (2013.01); *B65H 2401/22* (2013.01); *B65H 2515/60* (2013.01); *B65H 2553/42* (2013.01); *B65H 2553/46* (2013.01); *B65H 2701/172* (2013.01); *B65H 2701/1722* (2013.01); *B65H 2701/37* (2013.01); *B65H 2701/378* (2013.01)

(58) Field of Classification Search
CPC ..... B65H 2701/172; B65H 2701/1722; B65H 2701/1724; B65H 2701/1726; B65H 2701/17262; B65H 2701/1727; B65H 2401/22; B65H 2515/60; H05K 13/02; H05K 13/0419; B65C 9/006; B65C 9/18; B65C 9/1865; B65C 2009/0009; B65C 2009/0012
USPC ..... 242/324
See application file for complete search history.

(56) References Cited

U.S. PATENT DOCUMENTS 5,252,169 A * 10/1993 Bechmann ..... B26D 7/1827 156/499
5,300,160 A * 4/1994 Wilson ..... B65C 9/1884 156/542
5,454,900 A * 10/1995 Han ..... B65H 41/00 156/701
5,879,505 A * 3/1999 Fujisawa ..... B65H 41/00 156/760
5,938,890 A * 8/1999 Schlinkmann ..... B65C 9/1884 221/73
8,453,700 B2 * 6/2013 Painter ..... B65C 1/025 156/542
8,974,615 B2 * 3/2015 Dods ..... B65C 9/1865 156/73.6
2002/0117263 A1 * 8/2002 McKenney ..... B65C 9/44 156/64
2003/0053139 A1 * 3/2003 McKim ..... B65H 39/16 358/300
2003/0070750 A1 * 4/2003 Moore ..... B65H 20/04 156/566
2006/0289118 A1 * 12/2006 Yi-Ju ..... B65H 37/005 156/577
2007/0039684 A1 * 2/2007 Nedblake ..... B65C 9/1876 156/247
2008/0017321 A1 * 1/2008 Crouch ..... B65C 9/1865 156/391
2009/0266486 A1 * 10/2009 Ihara ..... B42D 25/455 156/752
2010/0101733 A1 * 4/2010 Yu Chen ..... B65H 37/002 156/459
2011/0036477 A1 * 2/2011 Kato ..... B65H 35/0013 156/64
2013/0126100 A1 * 5/2013 Fujita ..... B65C 9/0006 156/719
2013/0135729 A1 * 5/2013 Hirata ..... B65H 18/28 156/538
2015/0367623 A1 * 12/2015 Tokuda ..... B65C 9/0006 156/575
2016/0159068 A1 * 6/2016 Yan ..... B65H 41/00 156/759
2017/0087817 A1 * 3/2017 Tomaki ..... B32B 37/0053
2021/0008896 A1 * 1/2021 Takami ..... B41J 3/4075
2021/0008897 A1 * 1/2021 Takami ..... B41J 29/393
2021/0039914 A1 * 2/2021 Takami ..... B41J 3/4075
2021/0284481 A1 * 9/2021 Bayzelon ..... B65H 20/02
2022/0132713 A1 * 4/2022 Isobata ..... B65H 20/20
2022/0340322 A1 * 10/2022 Ide ..... B65C 9/1865
2023/0226826 A1 * 7/2023 Endo ..... B41J 3/4075 347/110
2023/0234797 A1 * 7/2023 Chokyu ..... H01M 8/1004
2023/0271803 A1 * 8/2023 Isobata ..... H05K 13/0419 156/767
2023/0286765 A1 * 9/2023 Choi ..... H01M 10/0409

FOREIGN PATENT DOCUMENTS

KR 20050105011 A 11/2005
KR 20060117007 A 11/2006
KR 100881337 B1 2/2009
KR 20130088657 A 8/2013
KR 20150060021 A * 6/2015 ..... B29C 63/02
KR 20150063810 A * 6/2015 ..... B65H 29/54
KR 20160001632 A * 1/2016 ..... B65H 41/00
KR 101613151 B1 * 4/2016 ..... B65H 41/00
KR 102022472 B1 9/2019
KR 20200042167 A 4/2020
KR 102212238 B1 * 2/2021 ..... B65H 41/00
KR 20210067304 A 6/2021
KR 20210151269 A 12/2021

* cited by examiner

TAPE FEEDING APPARATUS

This application claims priority to Korean Patent Application No. 10-2022-0180219, filed on Dec. 21, 2022, and all the benefits accruing therefrom under 35 U.S.C. § 119, the content of which in its entirety is herein incorporated by reference.

BACKGROUND

1. Technical Field

The disclosure relates to a tape feeding apparatus.

2. Description of the Related Art

The display device is a device that displays an image for providing visual information to a user. In general, the display device such as a smartphone, a laptop, a tablet, and a TV are equipped with a printed circuit board and a driving chip in which small parts are complexly mounted.

A plurality of circuit wirings are formed on the printed circuit board and the driving chip. In addition, tapes are attached to the printed circuit board and the driving chip for protecting the substrate, shielding electromagnetic waves, insulation, prevention of light leakage, and attachment of equipment.

SUMMARY

Embodiments provide a tape feeding apparatus with improved quality.

A tape feeding apparatus according to an embodiment includes a supply unit that supplies a release paper and a tape attached to the release paper, a blade unit that separates the release paper and the tape, having a triangular pillar shape extending in a first direction, and including a first surface, a second surface perpendicular to the first surface and capable of contacting the release paper, and a third surface in contact with the first surface and the second surface to form a sloped surface, and a lighting unit attached to the first surface.

In an embodiment, the tape feeding apparatus may further include a reflective plate attached to the third surface.

In an embodiment, an angle formed by the second surface and the third surface may be about 10 degrees or more and about 20 degrees or less.

In an embodiment, the blade unit may be capable of moving in a second direction crossing the first direction.

In an embodiment, a plurality of holes extending in the first direction may be defined in the lighting unit.

In an embodiment, the tape feeding apparatus may further include a collection unit that collects the release paper from which the tape is separated and a camera unit that detects a position of the tape.

In an embodiment, a length of the second surface in a second direction crossing the first direction may be longer than a length of the first surface in a third direction perpendicular to a plane formed by the first direction and the second direction.

A tape feeding apparatus according to an embodiment includes a supply unit that supplies a release paper and a tape attached to the release paper, a blade unit that separates the release paper and the tape, having a triangular pillar shape extending in a first direction, and including a first surface, a second surface perpendicular to the first surface and capable of contacting the release paper, and a third surface in contact with the first surface and the second surface to form a sloped surface, and a lighting unit attached to the third surface.

In an embodiment, the tape feeding apparatus may further include a reflective plate attached to the first surface.

In an embodiment, an angle formed by the second surface and the third surface may be about 10 degrees or more and about 20 degrees or less.

In an embodiment, the blade unit may be capable of moving in a second direction crossing the first direction.

In an embodiment, a plurality of holes extending in the first direction may be defined in the lighting unit.

In an embodiment, the tape feeding apparatus may further include a collection unit that collects the release paper from which the tape is separated and a camera unit that detects a position of the tape.

In an embodiment, a length of the second surface in a second direction crossing the first direction may be longer than a length of the first surface in a third direction perpendicular to a plane formed by the first direction and the second direction.

A tape feeding apparatus according to an embodiment includes a supply unit that supplies a release paper and a tape attached to the release paper, a blade unit that separates the release paper and the tape, having a triangular pillar shape extending in a first direction, and including a first surface, a second surface perpendicular to the first surface and capable of contacting the release paper, a third surface in contact with the first surface and the second surface to form a sloped surface, a first side surface located adjacent to one end of each of the first to third sides, and a second side surface located adjacent to the other end of each of the first to third sides, a first lighting unit attached to the first side surface, and a camera unit that detects a position of the tape.

In an embodiment, the tape feeding apparatus may further include a second lighting unit attached to the second side surface.

In an embodiment, a plurality of holes may be defined in the first lighting unit and the second lighting unit.

In an embodiment, the tape feeding apparatus may further include a reflective plate attached to the third surface.

In an embodiment, an angle formed by the second surface and the third surface may be about 10 degrees or more and about 20 degrees or less.

In an embodiment, the blade unit may be capable of moving in a second direction crossing the first direction.

A tape feeding apparatus according to an embodiment includes a supply unit that supplies a release paper and a tape attached to the release paper, a blade unit that separates the release paper and the tape, having a triangular pillar shape extending in a first direction, and including a first surface, a second surface perpendicular to the first surface and capable of contacting the release paper, and a third surface in contact with the first surface and the second surface to form a sloped surface, and a lighting unit attached to the first surface.

Accordingly, even if a curl occurs in the release paper and/or the tape, an image of the release paper and/or the tape taken using a camera may be uniform because the lighting unit may be placed under the blade unit.

In addition, through an integration of the blade unit and the lighting unit, it is possible to overcome a limitation of spatial design in which lighting cannot be properly placed under the tape feeding apparatus.

BRIEF DESCRIPTION OF THE DRAWINGS

The above and other features of embodiments of the disclosure will become apparent by describing in detail embodiments thereof with reference to the accompanying drawings.

DETAILED DESCRIPTION

Figure 1:
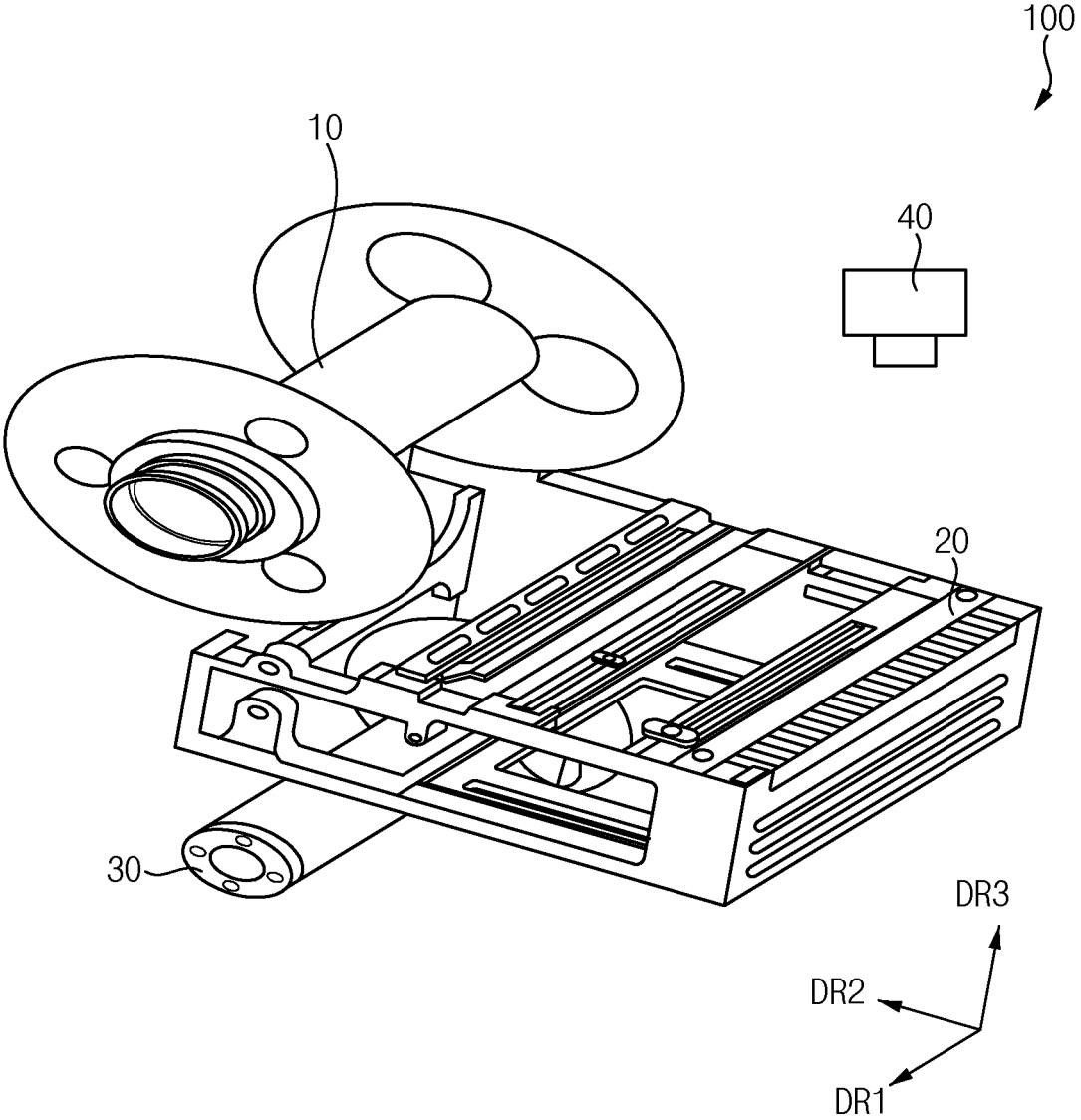
FIG. 1 is a perspective view illustrating a tape feeding apparatus according to an embodiment.

Hereinafter, display devices in accordance with embodiments will be described in more detail with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. The same reference numerals are used for the same components in the drawings, and redundant descriptions of the same components will be omitted.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

For the purposes of this disclosure, "at least one of A and B" may be construed as A only, B only, or any combination of A and B. Also, "at least one of X, Y, and Z" and "at least one selected from the group consisting of X, Y, and Z" may be construed as X only, Y only, Z only, or any combination of two or more of X, Y, and Z. In the specification and the claims, the term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or."

Unless otherwise defined or implied herein, all terms (including technical and scientific terms) used have the same meaning as commonly understood by those skilled in the art to which this disclosure pertains. It will be further understood that terms, such as those defined in commonly used dictionaries, should be interpreted as having a meaning that is consistent with their meaning in the context of the relevant art and should not be interpreted in an ideal or excessively formal sense unless clearly defined in the specification.

FIG. 1 is a perspective view illustrating a tape feeding apparatus according to an embodiment. FIGS. 2 to 6 are cross-sectional views illustrating a process of operating the tape feeding apparatus of FIG. 1 in chronological sequential order.

Figure 2:
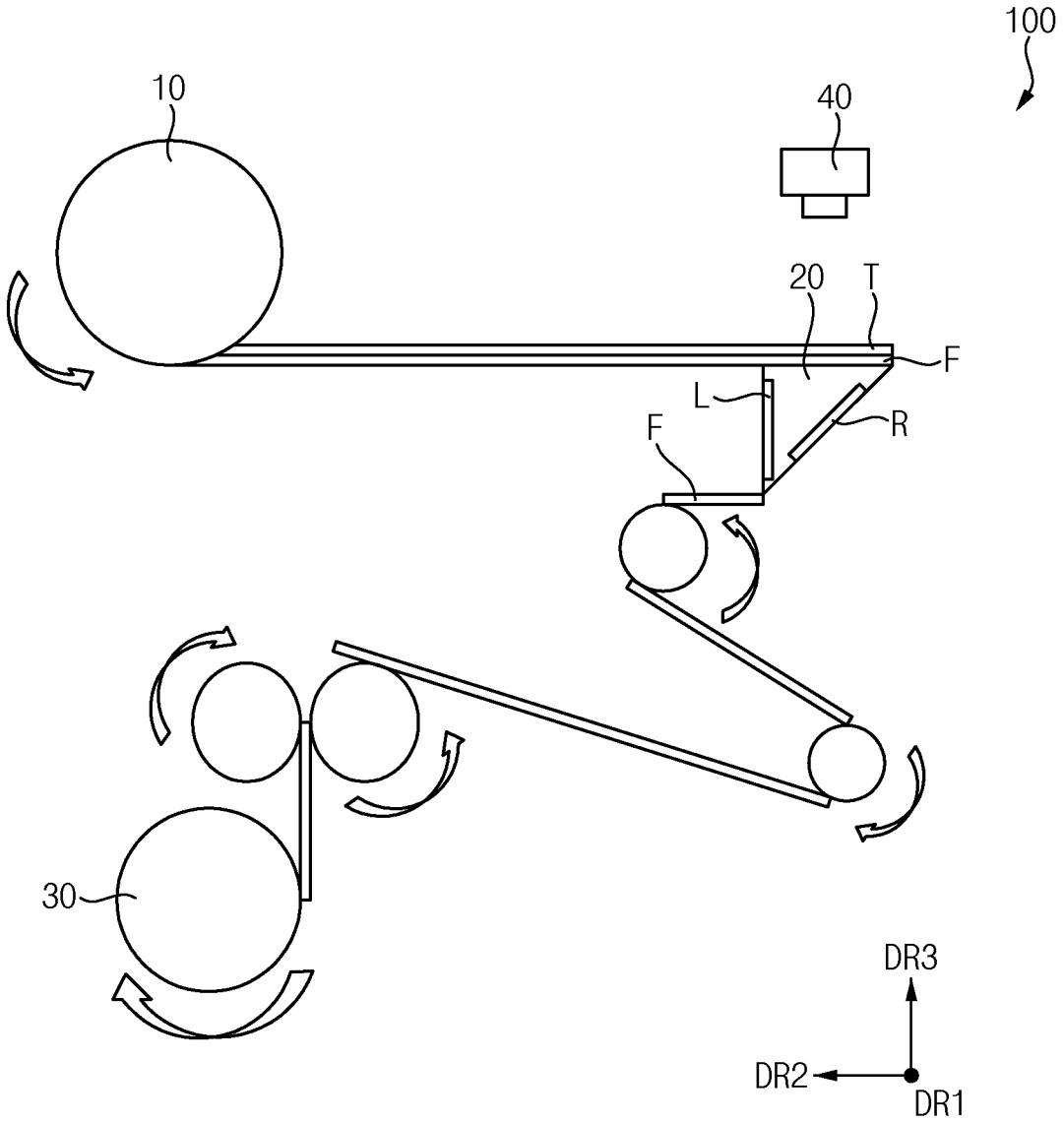
FIG. 2 is a cross-sectional view illustrating a first sequence of a process of operating the tape feeding apparatus of FIG. 1, according to an embodiment.

Referring to FIGS. 1 and 2, a tape feeding apparatus 100 according to an embodiment may include a supply unit 10, a blade unit 20, a collection unit 30, a camera unit 40, a lighting unit L, and a reflective plate R. The supply unit 10 may supply a release paper F and a tape T attached on the release paper F.

In an embodiment, the supply unit 10 may rotate about a rotation shaft extending in a first direction DR1. As the supply unit 10 rotates, the supply unit 10 may supply the release paper F and the tape T attached on the release paper F to a blade unit 20, wherein the tape T may be made of a material that transmits light.

In an embodiment, a blade unit 20 may have a triangular pillar shape extending in the first direction DR1. The release paper F and the tape T provided from the supply unit 10 may be placed on a second surface (e.g., a second surface 22 of FIG. 7) of the blade unit 20. In an embodiment, the supply unit 10 and the blade unit 20 may be spaced apart from each other in a second direction DR2 crossing the first direction DR1.

In an embodiment, a camera unit 40 may be spaced apart from the blade unit 20 in a third direction DR3 perpendicular to the plane formed by the first direction DR1 and the second direction DR2. The camera unit 40 may be configured to photograph shapes of the release paper F and the tape T. The camera unit 40 can photograph the shapes of the release paper F and the tape T using light (e.g., multiple lights LA, LB, LC in FIG. 8) from a lighting unit L.

Accordingly, in an embodiment, in an event of a problem, such as the tape T being supplied with a curl, the above problem can be recognized through the camera unit 40. In addition, the camera unit 40 may monitor positions of the release paper F and/or the tape T in real time.

In an embodiment, the release paper F from which the tape T is separated may be collected through a collection unit 30. The collection unit 30 may rotate about a rotation shaft extending in the first direction DR1. As the collection unit 30 rotates, the collection unit 30 may collect the release paper F. In an embodiment, the collection unit 30 may be spaced apart from the supply unit 10 in a direction opposite to the third direction DR3.

Hereinafter, an embodiment of a process of operating the tape feeding apparatus 100 will be described in detail with reference to FIGS. 2 to 6.

Figure 7:
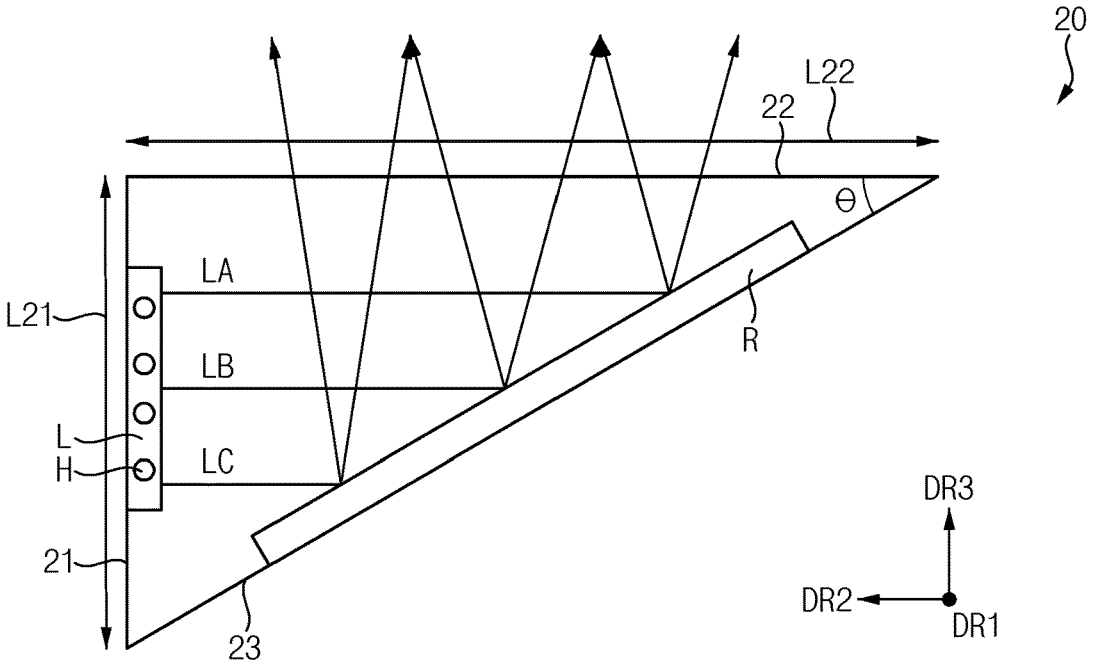
FIG. 7 is a cross-sectional view illustrating a blade unit included in the tape feeding apparatus of FIG. 1, according to an embodiment.

In an embodiment and referring to FIG. 2, the release paper F and the tape T attached on the release paper F supplied from the supply unit 10 may be settled on a second surface of the blade unit 20 (e.g., a second surface 22 of FIG. 7).

Figure 3:
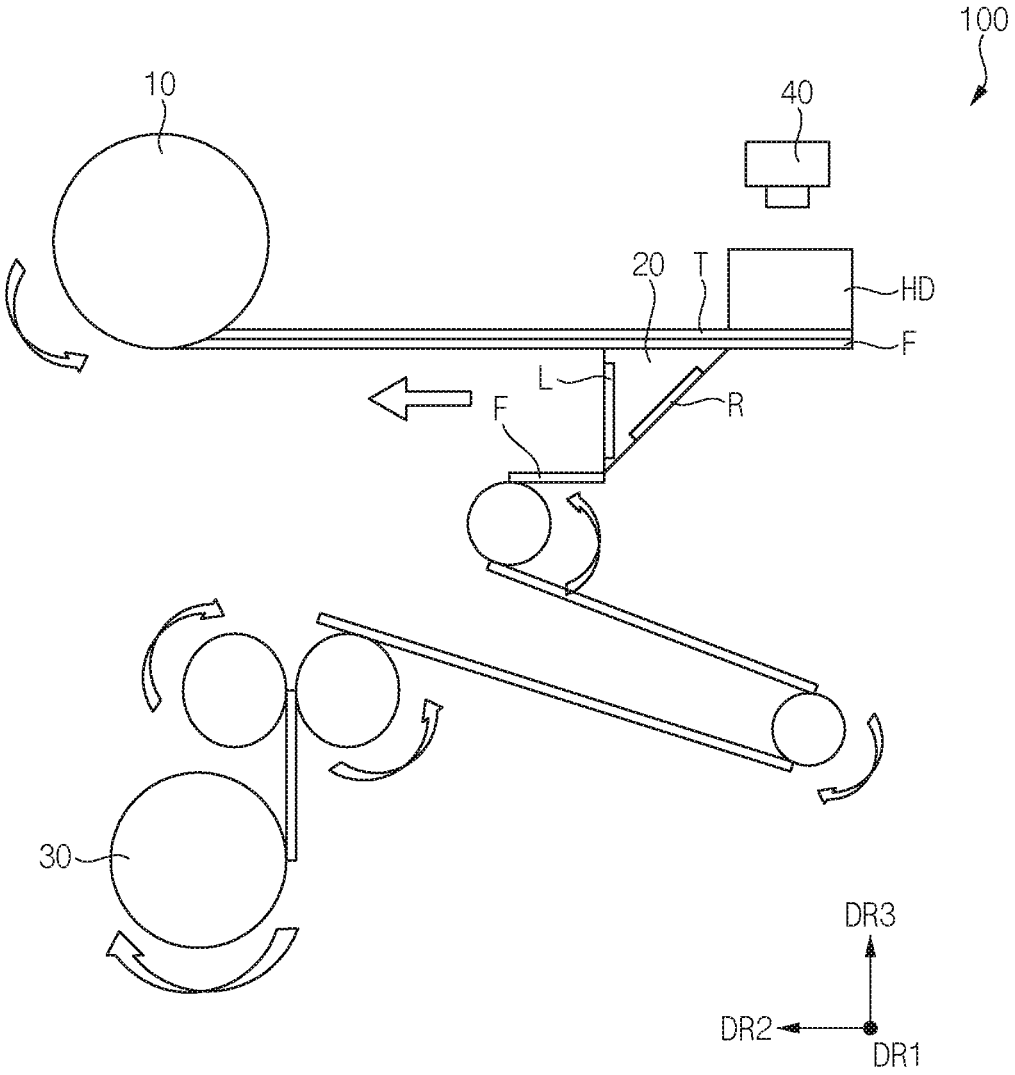
FIG. 3 is a cross-sectional view illustrating a second sequence of a process of operating the tape feeding apparatus of FIG. 1, according to an embodiment.

In an embodiment and referring to FIG. 3, the blade unit 20 may move in the second direction DR2, where the release paper F and the tape T are separated and the tape T may be associated with a head HD which may attach the tape T to a target substrate (not shown).

Figure 4:
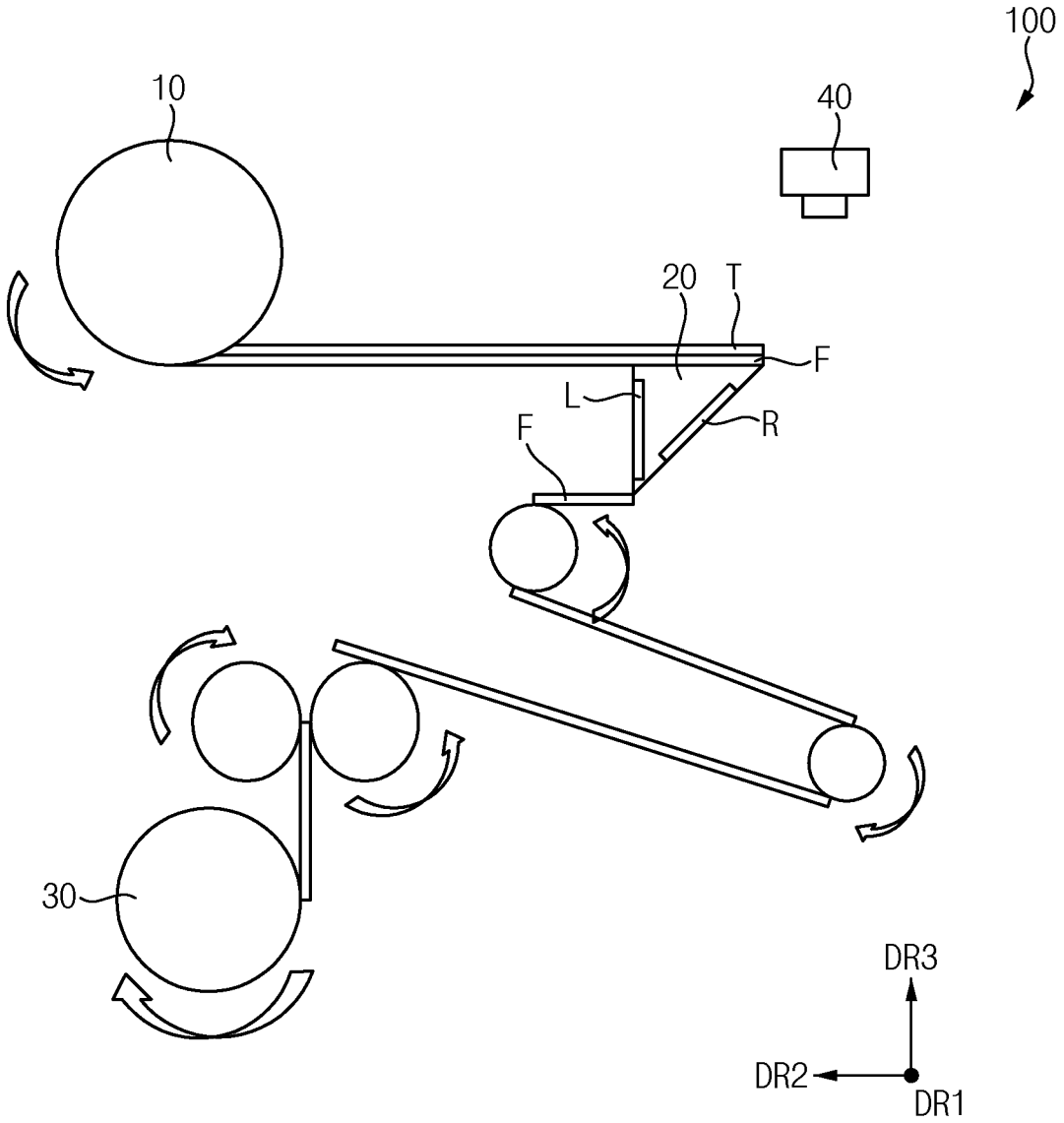
FIG. 4 is a cross-sectional view illustrating a third sequence of a process of operating the tape feeding apparatus of FIG. 1, according to an embodiment.

In an embodiment and referring to FIG. 4, the release paper F from which the tape T is separated may move along a third surface (e.g., a third surface 23 of FIG. 7) of the blade unit 20. Thereafter, the release paper F may be collected by the collection unit 30.

Figure 5:
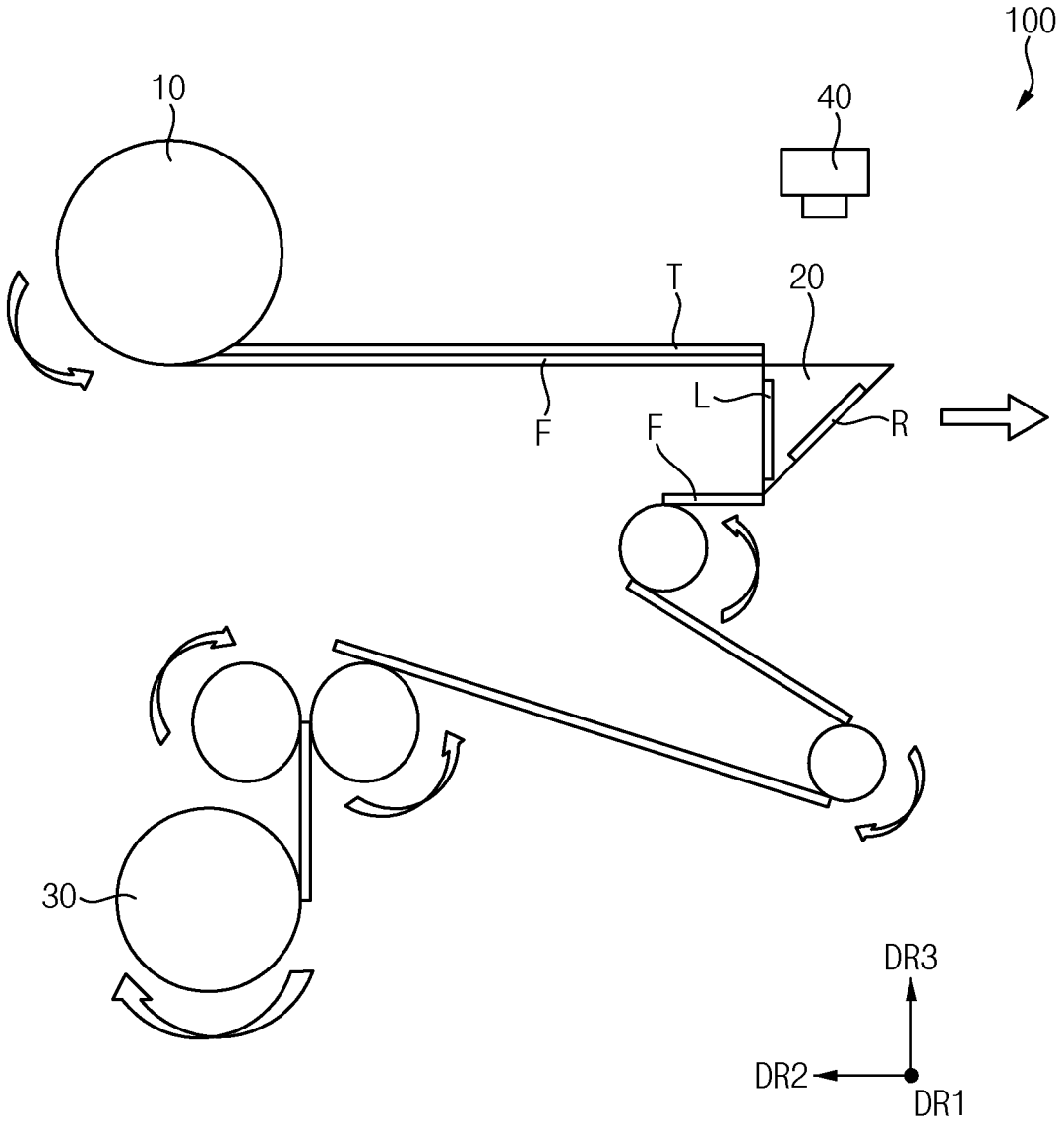
FIG. 5 is a cross-sectional view illustrating a fourth sequence of a process of operating the tape feeding apparatus of FIG. 1, according to an embodiment.

In an embodiment and referring to FIG. 5, the blade unit 20 may move away from the supply unit 10 in a direction opposite to the second direction DR2. That is, the blade unit 20 may move to a position in a direction away from the supply unit 10 before moving in the second direction DR2 in FIG. 3 toward the supply unit 10.

Figure 6:
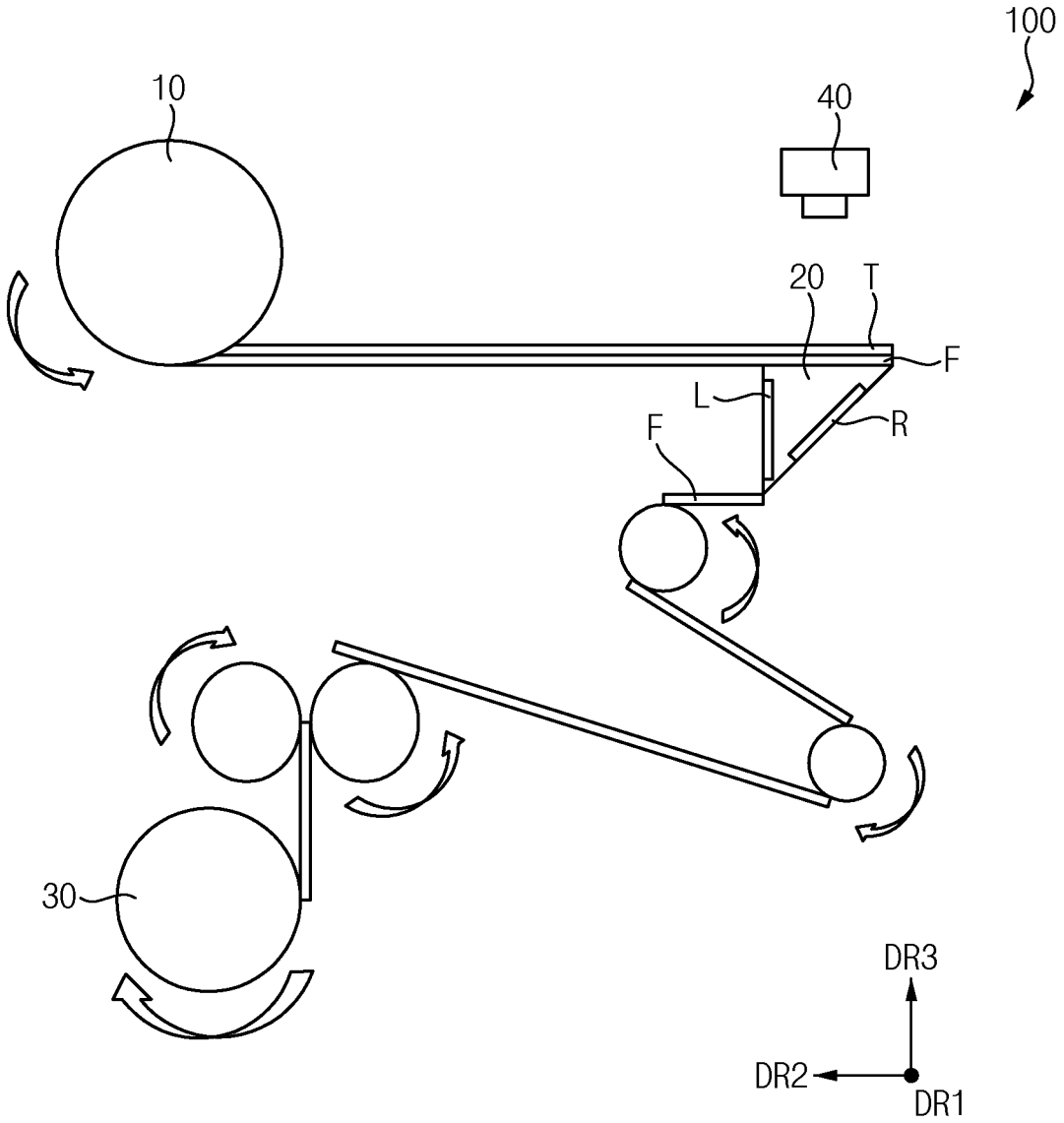
FIG. 6 is a cross-sectional view illustrating a fifth sequence of a process of operating the tape feeding apparatus of FIG. 1, according to an embodiment.

In an embodiment and referring to FIG. 6, the release paper F and the tape T attached on the release paper F may be supplied from the supply unit 10. In other words, the supply unit 10 can supply release paper T and tape T so that release paper F and tape T may settle on the second surface of the blade unit 20. In this case, positions of the release paper T and the tape T may be monitored through the camera unit 40 or a sensor (not shown).

In an embodiment, the tape feeding apparatus 100 may repeat the processes of FIGS. 2 to 6. That is, the tape feeding apparatus 100 may supply the tape T to the target substrate while repeating the processes of FIGS. 2 to 6.

FIG. 7 is a cross-sectional view illustrating a blade unit included in the tape feeding apparatus of FIG. 1, in an embodiment.

Referring to FIG. 7, the blade unit 20 according to an embodiment may have a triangular pillar shape including a first surface 21, a second surface 22, and a third surface 23. The blade unit 20 may extend in the first direction DR1 and/or the blade unit 20 may include a transparent material through which light may be transmitted.

In an embodiment, the first surface 21 may be a plane defined by the first direction DR1 and the third direction DR3. The second surface 22 may be directed to be perpendicular to the first surface 21. That is, the second surface 22 may be a plane defined by the first direction DR1 and the second direction DR2. The third surface 23 may be in contact with the first surface 21 and the second surface 22 to form a sloped surface of the triangular pillar.

In an embodiment, an angle θ formed by the second surface 22 and the third surface 23 may be about 10 degrees or more and about 20 degrees or less. In an embodiment, the angle θ formed by the second surface 22 and the third surface 23 may be about 15 degrees.

In an embodiment, a length L22 of the second surface 22 in the second direction DR2 may be longer than a length L21 of the first surface 21 in the third direction DR3.

A lighting unit L may be attached to the first surface 21. In an embodiment, the lighting unit L may exist inside a triangular pillar cavity formed by the first surface 21, the second surface 22, and the third surface 23. However, the present disclosure is not limited thereto. That is, the lighting unit L may exist outside the triangular pillar cavity. FIG. 7 may illustrate an embodiment in which the lighting unit L is present in the triangular pillar.

In an embodiment, the lighting unit L may have a rectangular shape on a plane defined by the first direction DR1 and the third direction DR3. For example, the lighting unit L may extend in the first direction DR1 like the blade unit 20.

In an embodiment, the lighting unit L may be one configuration included in the blade unit 20. In an embodiment, a plurality of lights LA, LB, and LC may be generated in the lighting unit L. In an embodiment, a plurality of holes H extending in the first direction DR1 may be defined in the lighting unit L.

In an embodiment, heat that may be generated in the lighting unit L may be emitted by the plurality of holes H. Accordingly, temperatures of the lighting unit L and the blade unit 20 may be appropriately maintained. FIG. 7 may illustrate an example in which the plurality of holes H are four. However, the disclosure is not limited thereto.

In an embodiment, the plurality of lights LA, LB, and LC generated by the lighting unit L may be reflected by the reflective plate R. The plurality of light LA, LB, and LC reflected by the reflective plate R may pass through the second surface 22. The reflective plate R may be attached to the third surface 23. In an embodiment, the reflective plate R may exist inside the triangular pillar.

However, the present disclosure is not limited thereto. That is, in an embodiment, the reflective plate R may exist outside the triangular pillar. FIG. 7 may illustrate an embodiment in which the reflective plate R is present inside the triangular pillar cavity. In an embodiment, the reflective plate R may extend in the first direction DR1 like the blade unit 20. The reflective plate R may be one configuration included in the blade unit 20.

In an embodiment and referring to FIGS. 2 and 7, the lighting unit L may not be disposed to be above the release paper F and the tape T, but may be disposed to be below the release paper F and the tape T. That is, the lighting unit L may be included in the blade unit 20 to be disposed under the release paper F and the tape T. Accordingly, even if a curl occurs in the release paper F, the plurality of lights LA, LB, and LC emitted from the lighting unit L may be prevented from being scattered or reflected by the curl.

In addition, in an embodiment, the plurality of lights LA, LB, and LC may not be affected by a material contained in the release paper L or the tape T. The camera unit 40 may monitor the release paper F and/or the tape T using the plurality of lights LA, LB, and LC emitted from the lighting unit L. Accordingly, an image of the release paper F and/or the tape T obtained through the camera unit 40 may be uniform.

Figure 8:
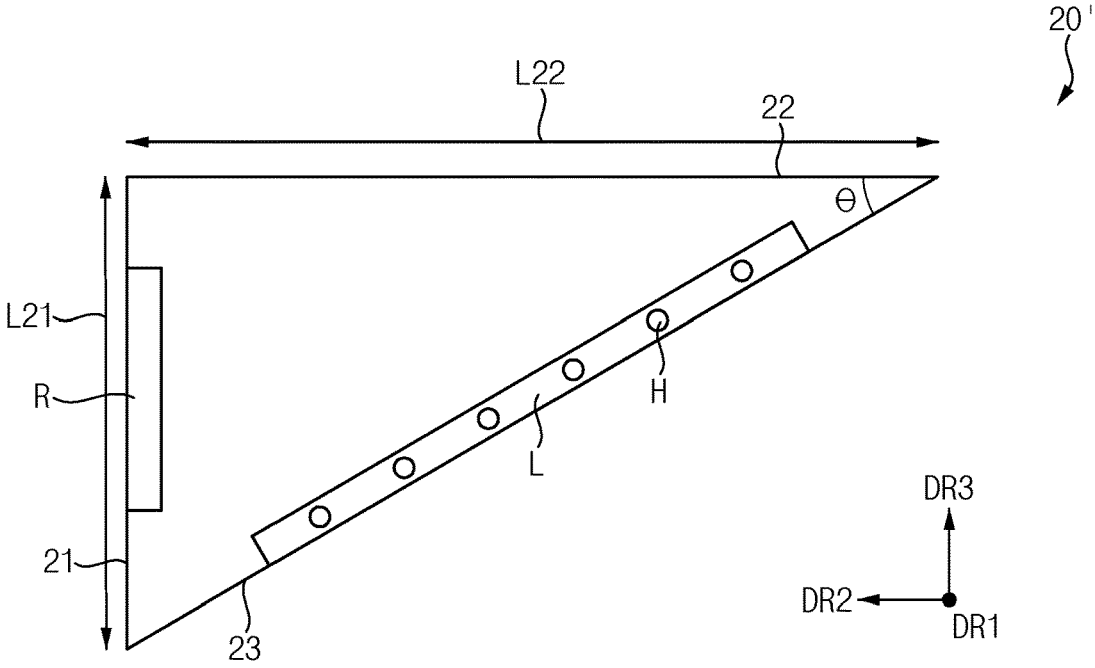
FIG. 8 is cross-sectional view illustrating a blade unit according to another embodiment.
Figure 9:
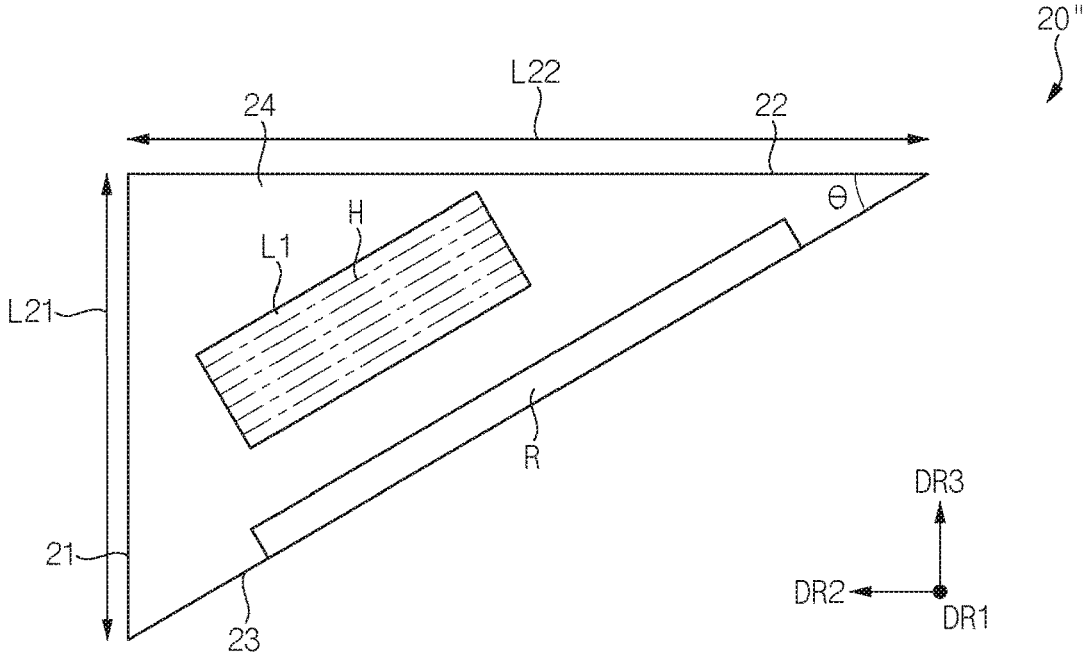
FIG. 9 is a cross-sectional view illustrating a blade unit according to yet another embodiment.
Figure 10:
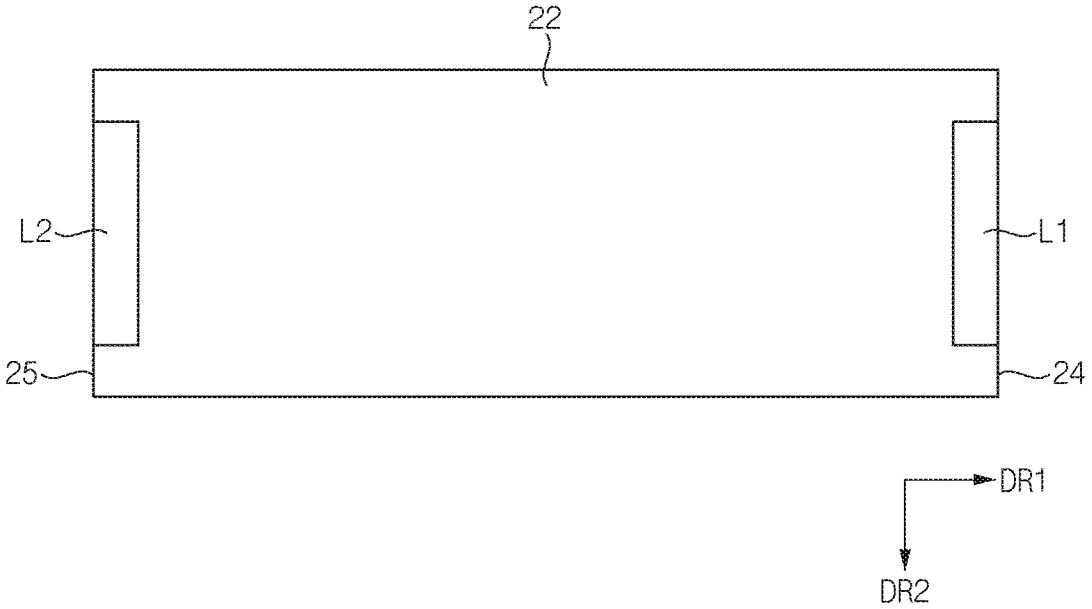
FIG. 10 is a plan view illustrating the blade unit of FIG. 9, according to an embodiment.

FIG. 8 is cross-sectional view illustrating a blade unit according to another embodiment. FIG. 9 is a cross-sectional view illustrating a blade unit according to yet another embodiment. FIG. 10 is a plan view illustrating the blade unit of FIG. 9. Specifically, FIG. 8 illustrates an embodiment in which the lighting unit L is attached to the third surface 23 of the blade unit 20, and FIG. 9 and FIG. 10 illustrate an embodiment in which the lighting units L1 and L2 are attached to both side surfaces 24 and 25 of the blade unit 20.

In describing the blade unit 20' of FIG. 8 and the blade unit 20" of FIG. 9 and FIG. 10, the same reference numerals are assigned to components that are substantially the same as the blade unit 20 of FIG. 7, and the detailed description thereof may be omitted.

Referring to FIG. 8, a blade unit 20' according to another embodiment may have a triangular pillar shape including a first surface 21, a second surface 22, and a third surface 23. The blade unit 20' may extend in the first direction DR1.

In an embodiment, the first surface 21 may be a plane defined by the first direction DR1 and the third direction DR3. The second surface 22 may extend in a direction that is perpendicular to the first surface 21. That is, the second surface 22 may be a plane defined by the first direction DR1 and the second direction DR2. The third surface 23 may be in contact with the first surface 21 and the second surface 22 to form a sloped surface.

In an embodiment, an angle θ formed by the second surface 22 and the third surface 23 may be about 10 degrees or more and about 20 degrees or less. In an embodiment, the angle θ formed by the second surface 22 and the third surface 23 may be about 15 degrees.

In an embodiment, a length L22 of the second surface 22 in the second direction DR2 may be longer than a length L21 of the first surface 21 in the third direction DR3.

The lighting unit L may be attached to the third surface 23. In an embodiment, the lighting unit L may exist inside the triangular pillar cavity formed by the first surface 21, the second surface 22, and the third surface 23. However, the disclosure is not limited thereto. That is, the lighting unit L may exist outside the triangular pillar cavity. FIG. 8 may illustrate a state in which the lighting unit L is present within the triangular pillar cavity.

In an embodiment, the lighting unit L may extend in the first direction DR1 like the blade unit 20'. In addition, the lighting unit L may be one configuration included in the blade unit 20'. In an embodiment, a plurality of holes H extending in the first direction DR1 may be defined in the lighting unit L. FIG. 8 may illustrate an example in which the plurality of holes H are six. However, the disclosure is not limited thereto.

In an embodiment, the reflective plate R may be attached to the first surface 21. In an embodiment, the reflective plate R may exist inside the triangular pillar cavity. However, the disclosure is not limited thereto. That is, the reflective plate R may exist outside the triangular pillar cavity. FIG. 8 may illustrate a state in which the reflective plate R is present within the triangular pillar cavity. The reflective plate R may extend in the first direction DR1 like the blade unit 20'. The reflective plate R may be one configuration included in the blade unit 20'.

Referring to FIGS. 9 and 10, a blade unit 20" according to another embodiment may have a triangular pillar shape including a first surface 21, a second surface 22, a third surface 23, a first side surface 24, and a second side surface 25. The blade unit 20" may extend in the first direction DR1.

In an embodiment, the first surface 21 may be a plane defined by the first direction DR1 and the third direction DR3. The second surface 22 may extend in a direction that is perpendicular to the first surface 21. That is, the second surface 22 may be a plane defined by the first direction DR1 and the second direction DR2. The third surface 23 may be in contact with the first surface 21 and the second surface 22 to form a sloped surface of the triangular pillar.

In an embodiment, the first side surface 24 may be adjacent to one end of each of the first to third surfaces 21, 22, and 23, respectively. In addition, the second side surface 25 may be adjacent to the other end of each of the first to third surfaces 21, 22, and 23, respectively. Each of the first side surface 24 and the second side surface 25 may have a triangular shape.

In an embodiment, an angle θ formed by the second surface 22 and the third surface 23 may be about 10 degrees or more and about 20 degrees or less. In an embodiment, the angle ζ formed by the second surface 22 and the third surface 23 may be about 15 degrees.

In an embodiment, a length L22 of the second surface 22 in the second direction DR2 may be longer than a length L21 of the first surface 21 in the third direction DR3.

In an embodiment, a first lighting unit L1 may be attached to the first side surface 24. In addition, the second lighting unit L2 may be attached to the second side surface 25. In an embodiment, the first lighting unit L1 and the second lighting unit L2 may exist inside the triangular pillar cavity consisting of the first surface 21, the second surface 22, the third surface 23, the first side surface 24, and the second side surface 25.

However, the disclosure is not limited thereto. That is, in an embodiment, the first lighting unit L1 and the second lighting unit L2 may exist outside the triangular pillar cavity. FIGS. 9 and 10 may illustrate an embodiment in which the first lighting unit L1 and the second lighting unit L2 are present within the triangular pillar cavity.

The first lighting unit L1 and the second lighting unit L2 may be one configuration included in the blade unit 20". In an embodiment, a plurality of holes H may be defined in the first lighting unit L1 and the second lighting unit L2. FIG. 9 may illustrate an embodiment in which the plurality of holes H are six. However, the disclosure is not limited thereto.

In an embodiment, a reflective plate R may be attached to the third surface 23. In an embodiment, the reflective plate R may exist inside the triangular pillar cavity. However, the disclosure is not limited thereto. That is, the reflective plate R may exist outside the triangular pillar. FIG. 9 may illustrate an embodiment in which the reflective plate R is present within the triangular pillar cavity. The reflective plate R may extend in the first direction DR1 like the blade unit 20". The reflective plate R may be one configuration included in the blade unit 20".

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the inventive concept as disclosed and as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims. These embodiments are provided so that this disclosure will be thorough and complete and will fully convey the concept of the invention to those skilled in the art. Moreover, the embodiments or parts of the embodiments may be combined in whole or in part without departing from the scope of the invention.

What is claimed is:

1. A tape feeding apparatus comprising:

a supply unit that supplies a release paper and a tape attached to the release paper;

a blade unit that separates the release paper and the tape, having a triangular pillar shape extending in a first direction, and including a first surface, a second surface perpendicular to the first surface and contacting the release paper, and a third surface in contact with the first surface and the second surface to form a sloped surface; and a lighting unit attached to the first surface.

2. The tape feeding apparatus of claim 1, further comprising a reflective plate attached to the third surface.

3. The tape feeding apparatus of claim 1, wherein an angle formed by the second surface and the third surface is greater than or equal to about 10 degrees and less than or equal to about 20 degrees.

4. The tape feeding apparatus of claim 1, wherein the blade unit is movable in a second direction, wherein the second direction crosses the first direction.

5. The tape feeding apparatus of claim 1, wherein the lighting unit defines a plurality of holes facing in the first direction.

6. The tape feeding apparatus of claim 1, further comprising a collection unit that collects the release paper after the release paper is separated from the tape and a camera unit that detects a position of the tape.

7. The tape feeding apparatus of claim 1, wherein a length of the second surface in a second direction crossing the first direction is longer than a length of the first surface in a third direction which is perpendicular to a plane formed by the first direction and the second direction.

8. A tape feeding apparatus comprising:

a supply unit that supplies a release paper and a tape attached to the release paper;

a blade unit that separates the release paper and the tape, having a triangular pillar shape extending in a first direction, and including a first surface, a second surface directed perpendicular to the first surface and contacting the release paper, and a third surface in contact with the first surface and the second surface to form a sloped surface; and a lighting unit attached to the third surface.

9. The tape feeding apparatus of claim 8, further comprising a reflective plate attached to the first surface.

10. The tape feeding apparatus of claim 8, wherein an angle formed by the second surface and the third surface is greater than or equal to about 10 degrees and less than or equal to about 20 degrees.

11. The tape feeding apparatus of claim 8, wherein the blade unit is movable in a second direction, wherein the second direction crosses the first direction.

12. The tape feeding apparatus of claim 8, wherein a plurality of holes facing in the first direction are defined by the lighting unit.

13. The tape feeding apparatus of claim 8, further comprising a collection unit that collects the release paper after the release paper is separated from the tape and a camera unit that detects a position of the tape.

14. The tape feeding apparatus of claim 8, wherein a length of the second surface in directed in a second direction that crosses the first direction is longer than a length of the first surface directed in a third direction that is perpendicular to a plane formed by the first direction and the second direction.

15. A tape feeding apparatus comprising:

a supply unit that supplies a release paper and a tape attached to the release paper;

a blade unit that separates the release paper and the tape, having a triangular pillar shape that extends in a first direction, and including a first surface, a second surface directed perpendicular to the first surface and contacting the release paper, a third surface in contact with the first surface and the second surface to form a sloped surface, a first side surface adjacent to one end of each of the first surface, second surface and third surface, and a second side surface adjacent to other end of each of the first surface, second surface and third surface;

a first lighting unit attached to the first side surface; and a camera unit that detects a position of the tape.

16. The tape feeding apparatus of claim 15, further comprising a second lighting unit attached to the second side surface.

17. The tape feeding apparatus of claim 16, wherein a plurality of holes are defined in the first lighting unit and the second lighting unit.

18. The tape feeding apparatus of claim 15, further comprising a reflective plate attached to the third surface.

19. The tape feeding apparatus of claim 15, wherein an angle formed by the second surface and the third surface is greater than or equal to about 10 degrees and less than or equal to about 20 degrees.

20. The tape feeding apparatus of claim 15, wherein the blade unit is movable in a second direction, wherein the second direction crosses the first direction.

* * * * *